US011852419B1

(12) United States Patent
Williams et al.

(10) Patent No.: US 11,852,419 B1
(45) Date of Patent: Dec. 26, 2023

(54) AIR-COOLED HEAT EXCHANGER WITH TAB AND SLOT FRAME

(71) Applicant: Hudson Products Corporation, Ball Ground, GA (US)

(72) Inventors: Scott Williams, Tulsa, OK (US); Rod Day, Tulsa, OK (US); Steve Tietz, Tulsa, OK (US)

(73) Assignee: Hudson Products Corporation, Ball Ground, GA (US)

( * ) Notice: Subject to any disclaimer, the term of this patent is extended or adjusted under 35 U.S.C. 154(b) by 0 days.

(21) Appl. No.: 16/368,657

(22) Filed: Mar. 28, 2019

Related U.S. Application Data

(60) Provisional application No. 62/649,828, filed on Mar. 29, 2018.

(51) Int. Cl.
*F28D 1/00* (2006.01)
*F28D 1/02* (2006.01)
(Continued)

(52) U.S. Cl.
CPC ..... *F28D 1/024* (2013.01); *F28B 1/06* (2013.01); *F28F 9/001* (2013.01); *F28F 2009/222* (2013.01); *F28F 2280/06* (2013.01)

(58) Field of Classification Search
CPC ... F28D 1/024; F28B 1/06; F28F 9/001; F28F 2009/222; F28F 2280/06; F28F 2280/00; F28F 2280/04; F28F 2275/14; F28F 2275/143; F16B 5/0052; F16B 2200/30; F16B 3/06; F16B 2012/043; F16B 2012/046; F16B 12/34; E04B 2001/2412; E04B 2001/2409; E04B 2001/1975; E04B 2001/193; E04B 2001/1915; E04B 2001/1966; E04B 2001/2624–2632;
(Continued)

(56) References Cited

U.S. PATENT DOCUMENTS 1,662,768 A * 3/1928 Wait ..... E04B 1/2403 403/263
2,774,609 A * 12/1956 Winger ..... B62B 3/02 280/79.11
(Continued)

FOREIGN PATENT DOCUMENTS

CH 131867 A * 3/1929 ..... F16B 12/08

*Primary Examiner* — Travis Ruby
(74) *Attorney, Agent, or Firm* — Cook Alex Ltd.

(57) ABSTRACT

An air-cooled heat exchanger has a frame assembly that has a plurality of keyed structural members, where each of the plurality of keyed structural members is interconnected to a corresponding one of the plurality of keyed structural members with a unique mortise and tenon connection joint. Also disclosed is a method for manufacturing and assembling the frame assembly that begins with the step of providing a plurality of keyed structural members that each have a first connection joint component that is uniquely matched to a second connection joint component. The method continues with the step of assembling the frame assembly by interconnecting each of the plurality of keyed structural members using the first and second connection joint components. The method ends with the step of permanently connecting the frame assembly by permanently fastening each of the plurality of keyed structural members.

10 Claims, 5 Drawing Sheets

(51) Int. Cl.
*F28B 1/06* (2006.01)
*F28F 9/00* (2006.01)
*F28F 9/22* (2006.01)

(58) Field of Classification Search
CPC ..... E04B 1/1903; E04B 1/34384; E04B 2/08; E04C 2003/0486; E04C 2003/0417; E04G 7/26
See application file for complete search history.

(56) References Cited

U.S. PATENT DOCUMENTS 2,962,170 A * 11/1960 Best ..... A47B 57/54 211/182
3,082,492 A * 3/1963 Kenneth ..... B27F 1/00 403/381
3,090,086 A * 5/1963 Fata ..... F16B 12/24 403/381
3,132,443 A * 5/1964 Kuhn ..... A63H 33/044 446/112
3,160,249 A * 12/1964 Pavlecka ..... E04B 1/6158 52/586.2
3,384,165 A * 5/1968 Mathews ..... F28F 9/0136 165/122
3,468,571 A * 9/1969 Farmer ..... E04H 12/24 403/381
3,627,037 A * 12/1971 Carr, Jr. ..... F28B 1/06 165/122
3,685,579 A * 8/1972 Spangemacher ..... F28B 1/06 165/122
3,943,672 A * 3/1976 O'Sheeran ..... E04B 1/28 52/73
3,976,127 A * 8/1976 Harris ..... F28B 9/06 165/125
4,019,298 A * 4/1977 Johnson, IV ..... E04B 1/185 52/590.1
4,076,771 A * 2/1978 Houx, Jr. ..... F28F 25/12 261/159
4,096,670 A * 6/1978 Fuller ..... F16B 9/052 52/92.2
4,099,887 A * 7/1978 Mackenroth ..... A63H 33/065 403/4
4,513,813 A * 4/1985 Zanobini ..... F28B 1/06 165/110
4,532,747 A * 8/1985 Koetje ..... B63B 3/18 29/507
4,544,300 A * 10/1985 Lew ..... F16B 5/0052 403/170
4,557,091 A * 12/1985 Auer ..... F16B 5/0052 52/282.3
4,652,170 A * 3/1987 Lew ..... E04B 1/617 403/381
4,676,038 A * 6/1987 Doyon ..... A47B 47/0041 403/231
4,712,942 A * 12/1987 Brown ..... F16B 5/00 403/174
5,357,728 A * 10/1994 Duncanson ..... B27F 1/00 52/592.4
5,715,889 A * 2/1998 Peterson ..... F25B 39/00 165/67
8,281,529 B2 * 10/2012 Cluff ..... E04C 3/14 52/592.2
2001/0004823 A1 * 6/2001 Cronin ..... E06C 7/187 52/651.01
2002/0122691 A1 * 9/2002 Wood ..... F16B 5/0685 403/381
2005/0167093 A1 * 8/2005 Schaefer ..... F28B 1/06 165/300
2009/0026163 A1 * 1/2009 Lee ..... F16B 12/24 211/189
2010/0147487 A1 * 6/2010 Lewandowski ..... F28F 9/007 165/47
2010/0290831 A1 * 11/2010 Burnett ..... F16B 12/125 403/381
2011/0100593 A1 * 5/2011 Benz ..... F28F 1/36 165/59
2012/0023940 A1 * 2/2012 Kitz ..... F01K 25/08 60/641.2
2013/0092352 A1 * 4/2013 Martin ..... F28F 9/00 165/68
2013/0312932 A1 * 11/2013 Vouche ..... F28B 7/00 165/67
2014/0053599 A1 * 2/2014 Byfield ..... F25J 1/0296 62/611
2015/0093184 A1 * 4/2015 Henry ..... E04B 1/2604 403/187
2015/0345166 A1 * 12/2015 Quickelberghe ..... F01K 5/02 165/68

* cited by examiner

AIR-COOLED HEAT EXCHANGER WITH TAB AND SLOT FRAME

RELATED APPLICATIONS

The present application claims the benefit of U.S. Provisional Patent Application Ser. No. 62/649,828 filed Mar. 29, 2018 and entitled "Air-Cooled Heat Exchanger with Tab and Slot Frame," the disclosure of which is herein incorporated by reference.

FIELD OF THE INVENTION

The present invention generally relates to air-cooled heat exchangers, and more particularly, but not by way of limitation, to a system and method for constructing the structural frames used to support the body of the air-cooled heat exchanger.

BACKGROUND OF THE INVENTION

Air-cooled heat exchangers are used in a wide variety of industrial applications. A process fluid, either a gas or a liquid, is passed through a series of cooling tubes while air is mechanically passed over the exterior of the cooling tubes. The air absorbs heat from the cooling tubes, thereby lowering the temperature of the fluid within the tubes. The cooling tubes may include lateral or axial fins to aid in heat transfer.

Air cooled heat exchangers often include a large fan that forces or draws air at ambient conditions through a plenum fabricated from a series of panels supported by an underlying frame assembly. The fan is typically connected to a shaft, which is driven by an external engine or electric motor. The fan shaft is supported by durable bearings that reduce friction and provide axial and radial support to the fan and fan shaft.

The frame of the heat exchanger is typically constructed by precisely positioning and securing a series of structural members to one another. In many cases, the frame is constructed from a collection of plate, angle, channel and I-beam members. The manufacturer sources stock structural members and cuts the members to proper length and shape during the assembly process. Using drawings, an assembly team manually cuts, drills, notches, punches and miters the structural components on the factory floor. Once the various structural pieces have been prepared for assembly, the pieces are then manually positioned for fitment and welded together.

Although widely adopted, the manual preparation and fitment of the frame members may create inconsistencies or inaccuracies that frustrate and delay the assembly and welding process. Accordingly, there is a need for a frame system and assembly method that overcomes the deficiencies of the prior approaches. The presently preferred embodiments are directed to these and other deficiencies in the prior art.

SUMMARY OF THE INVENTION

In one embodiment, the present invention includes an air-cooled heat exchanger that has a plenum, a cooling tube assembly contained within the plenum, and a fan configured to move air across the cooling tube assembly. The air-cooled heat exchanger further includes a frame assembly that supports at least one of the plenum, the cooling tube assembly and the fan. The frame assembly has a plurality of keyed structural members that are each interconnected to one another with mortise and tenon connection joints.

In another aspect, the present invention includes a method for manufacturing and assembling the frame assembly of an air-cooled heat exchanger. The method begins with the step of providing a plurality of keyed structural members, wherein each of the plurality of keyed structural members is provided with a first connection joint component that is uniquely matched for connection with a corresponding second connection joint component on a corresponding keyed structural member. The method continues with the step of assembling the frame assembly by interconnecting each of the plurality of keyed structural members using the first and second connection joint components. The method ends with the step of permanently connecting the frame assembly by permanently fastening each of the plurality of keyed structural members.

In yet another embodiment, the present invention includes an air-cooled heat exchanger that has a plenum, a cooling tube assembly contained within the plenum and a fan configured to move air across the cooling tube assembly. The air-cooled heat exchanger further includes a frame assembly that supports the plenum. The frame assembly has a plurality of keyed structural members, where each of the plurality of keyed structural members is interconnected to a corresponding one of the plurality of keyed structural members with a unique mortise and tenon connection joint.

WRITTEN DESCRIPTION

Figure 1:
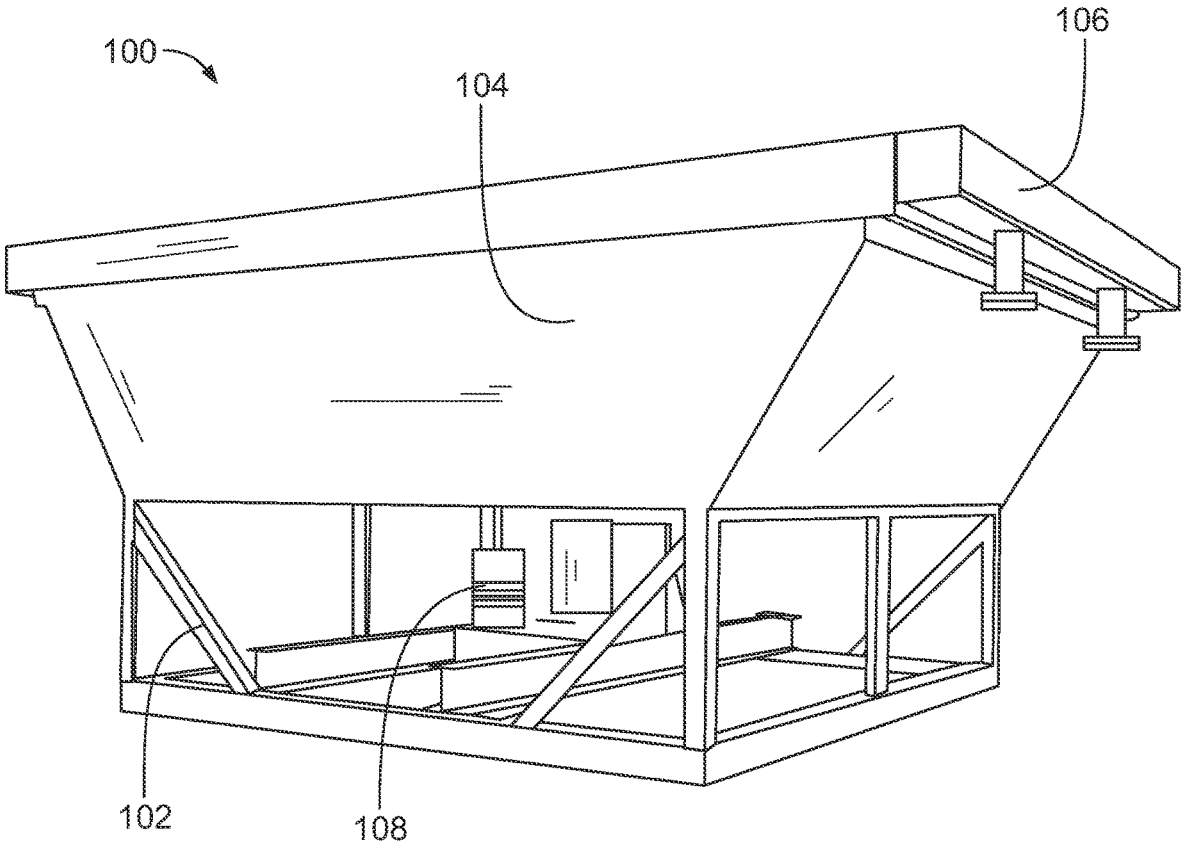
FIG. 1 is a perspective view of an air cooled heat exchanger constructed in accordance with an exemplary embodiment.

Referring to FIG. 1, shown therein is a perspective view of a horizontal air cooled heat exchanger 100. The air cooled heat exchanger 100 generally includes a frame assembly 102, a plenum 104, cooling tube assembly 106, motor assembly 108 and fan 110 (not visible in FIG. 1). The motor assembly 108 drives the fan 100, which pushes air through the plenum 104 across the cooling tube assembly 106. In accordance with well-known heat exchange principles, the movement of air at ambient temperatures is used to adjust the temperature of process fluid passing through the cooling tube assembly 106. The air cooled heat exchanger 100 can be used in a wide variety of applications, including gas compression, process cooling and lube oil cooling systems. Although the air cooled heat exchanger 100 is depicted as a horizontal unit with an electric motor assembly 108, it will be appreciated that the inventive systems disclosed herein will find utility in other air cooled heat exchanger designs, including vertically-oriented heat exchangers.

Figure 2:
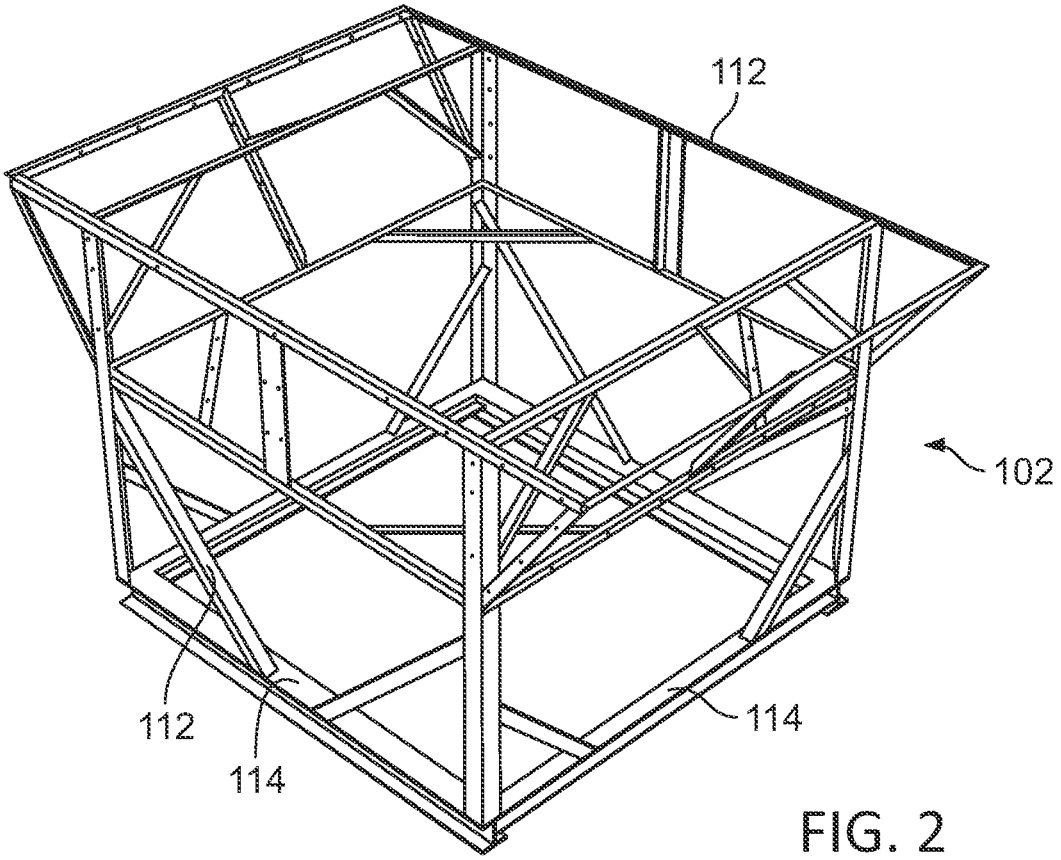
FIG. 2 is a perspective view of a frame assembly of the air cooled heat exchanger of FIG. 1.
Figure 3:
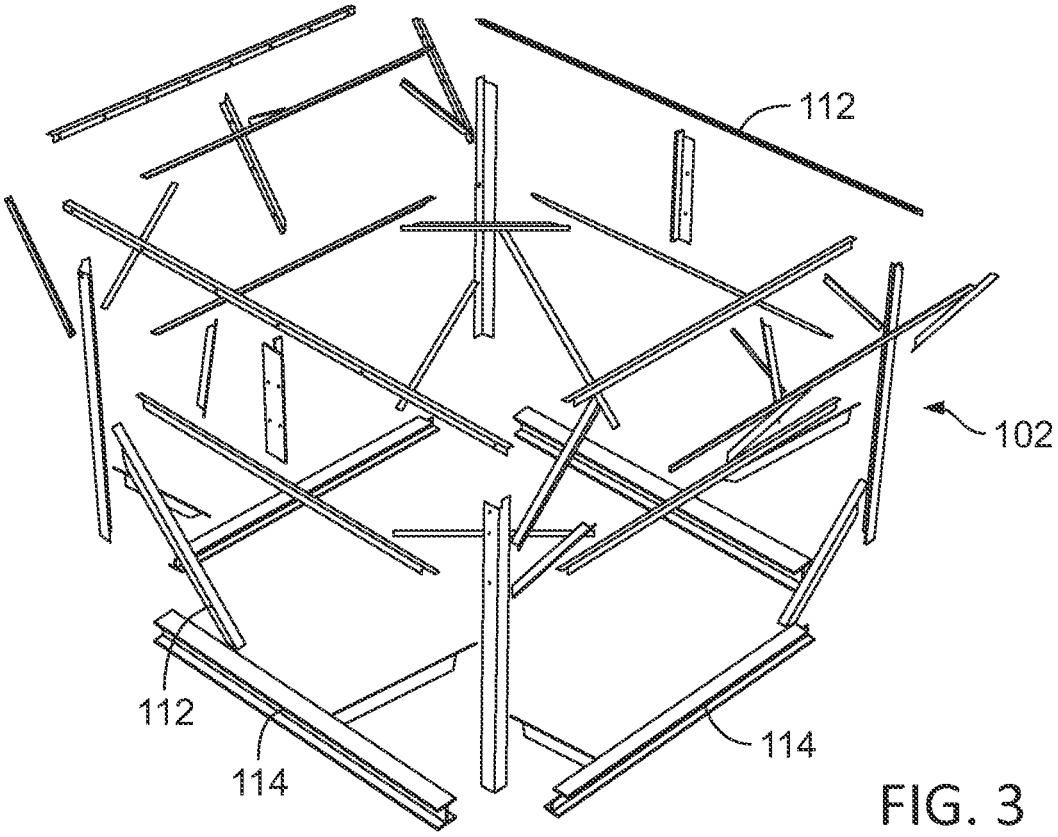
FIG. 3 is an exploded view of the air cooled heat exchanger of FIG. 2.

Turning to FIG. 2, shown therein is an isolated perspective view of the frame assembly 102. FIG. 3 depicts an exploded view of the frame assembly 102 of FIG. 2.

Generally, the frame assembly 102 includes a series of structural members 112 that when assembled support the body plates, fan, and cooling tubes of the air cooled heat exchanger 100. As depicted in FIGS. 2 and 3, the frame assembly 102 includes a base 114 constructed of I-beam members that support that balance of the structural members 112. Unless otherwise indicated, each component of the frame assembly 102 is manufactured from steel, aluminum or other durable, rigid metal.

Figure 4:
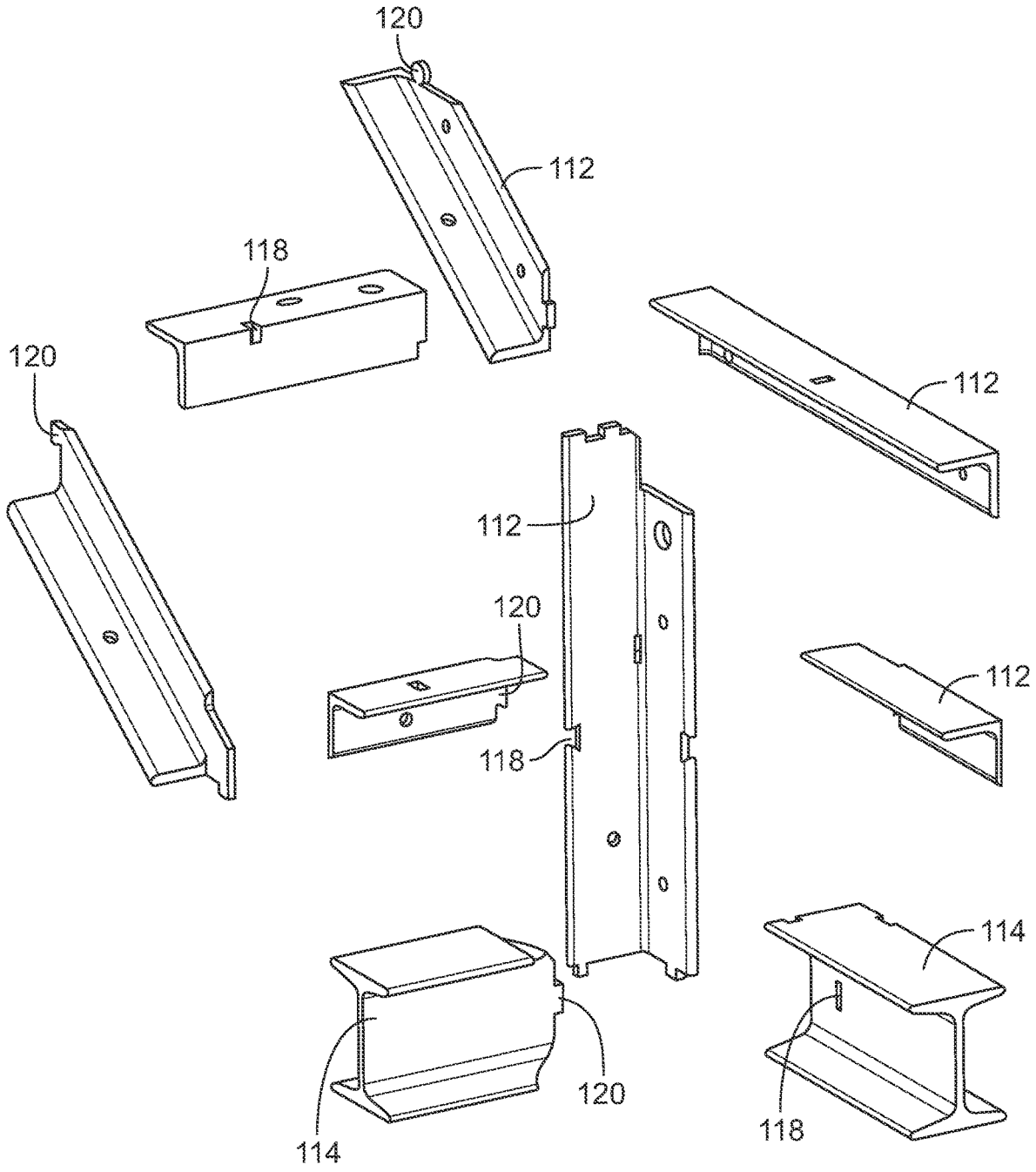
FIG. 4 is an exploded view of a series of structural components from the frame assembly of FIG. 2.
Figure 5:
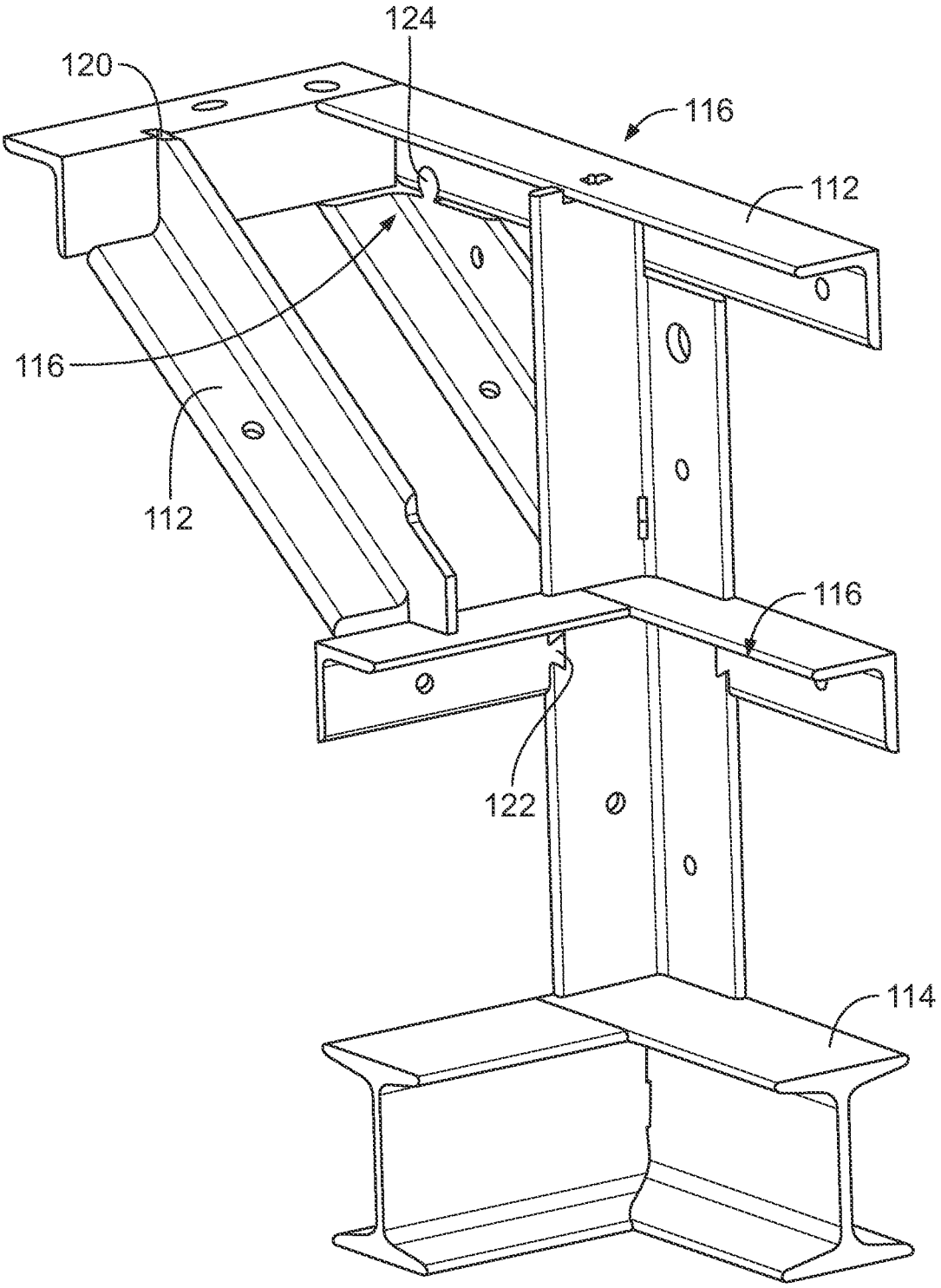
FIG. 5 is an interior assembled view of the structural components of FIG. 4.
Figure 6:
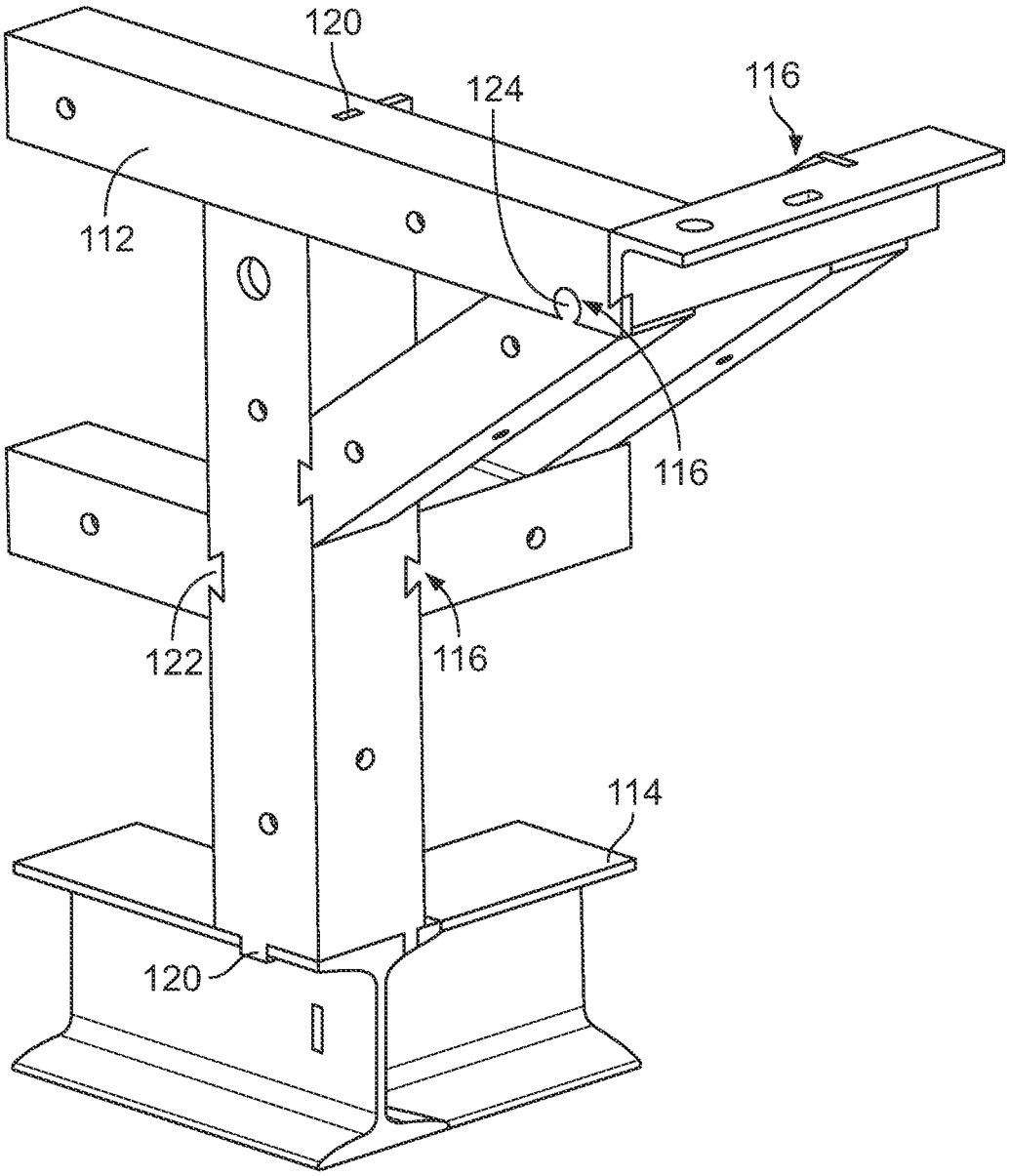
FIG. 6 is an exterior assembled view of the structural components of FIG. 4.

Turning to FIGS. 4-6, shown therein are close-up perspective views of the structural members 112 of an exemplary portion of the frame assembly 102. FIG. 4 provides an exploded (unassembled) view of the portion of the frame assembly 102 depicted in FIGS. 5-6. Unlike prior art frames, one or more of the structural members 112 are "keyed" for connection with a corresponding one of the structural member 112 with mating connection joints 116. Each connection joint 116 generally includes a mortise (or receiver) 118 and a corresponding, mating tenon (or extension) 120. As used herein, the term "mortise" refers generally to any receiver or female connection component and the term "tenon" refers to any projection or male connection component. The term "connection joint components" refers collectively to the tenon 120 and mortise 118 parts of the connection joints 116.

The connection joints 116 may be configured with different shapes and sizes. For example, the frame assembly 102 may have a number of unique connection joints 116, including dovetail 120, keyhole 122, and tab-and-slot 124 joints. In preferred embodiments, each of the mating joints 116 is uniquely configured or positioned on the structural members 112 such that a particular tenon 120 will only fit within an intended mortise 118 to prevent the improper assembly of the frame assembly 102. In particularly preferred embodiments, each of the structural members 112 is separately identified with numbers or other symbols to facilitate positioning of the frame assembly 102.

In exemplary embodiments, each of the structural members 112 is manufactured using advanced multi-axis, laser or high definition plasma machining to precisely cut the various structural members 112, base 114 and the associated connection joints 116 before the various pieces of the frame assembly 102 are delivered to an assembly location. Once the unassembled pieces of the frame assembly 102 have been moved to the assembly location, the frame assembly 102 can be assembled by securing the various structural members 112 together using the unique connection joints 116.

The connection joints 116 are preferably configured with sufficient interference to temporarily support the assembled structural members 112 without additional fasteners. The mating joints are preferably configured and oriented such that the frame assembly 102 can only be assembled correctly according to the plans for the air cooled heat exchanger 100. In this way, the frame assembly 102 is constructed like a jigsaw puzzle, with one or more solutions that follow the plans and blueprints for the air cooled heat exchanger 100. Once the components of the frame assembly 102 have been properly assembled for fitment, the structural members 112 can be permanently fastened together by welding, nuts and bolts, or other suitable fasteners.

Thus, the frame assembly 102 includes a plurality of uniquely "keyed" structural members 112 that are designed and manufactured to simplify and accelerate the process of positioning and securing the various pieces of the frame assembly 102. It will be understood that the frame assembly 102 may include both keyed structural members 112 and standard non-keyed structural members that are assembled using conventional manufacturing and assembly techniques. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms expressed herein and in the appended claims. It will be appreciated by those skilled in the art that the teachings of the present invention can be applied to other systems without departing from the scope and spirit of the present invention.

It is claimed:

1. An air-cooled heat exchanger comprising:

a plenum;

a planar cooling tube assembly contained within the plenum;

a fan configured to move air across the cooling tube assembly, said fan driven by a motor having a drive shaft extending perpendicular to a plane of the cooling tube assembly; and a frame assembly that supports at least one of the plenum, the cooling tube assembly and the fan, wherein the frame assembly comprises a plurality of keyed metal structural members having L-shaped cross sections, wherein a tenon keyed structural member includes a first tenon having a first tenon shape and a second tenon having a second tenon shape, where the first tenon shape differs from the second tenon shape, and the first and second tenons are interconnected to corresponding first and second mortises of first and second mortise keyed structural members, respectively, with a first mortise and tenon connection joint and a second mortise and tenon connection joint, respectively, with the first mortise and tenon connection joint including the first tenon and the first mortise, and the second mortise and tenon connection joint including the second tenon and the second mortise;

said first mortise including an opening formed entirely through the first mortise keyed structural member and circumferentially enclosed by metal;

wherein the first tenon is configured to fit within the first mortise but not the second mortise and the second tenon is configured to fit within the second mortise but not the first mortise so that the first mortise keyed structural member is configured to attach to the tenon keyed structural member only at the first mortise and tenon connection joint and the second mortise keyed structural member is configured to attach to the tenon keyed structural member only at the second mortise and tenon connection joint so as to prevent improper assembly of the frame assembly.

2. The air-cooled heat exchanger of claim 1, wherein the first mortise and tenon connection joint is a dovetail connection joint.

3. The air-cooled heat exchanger of claim 1, wherein the first mortise and tenon connection joint is a keyhole connection joint.

4. The air-cooled heat exchanger of claim 1, wherein the first mortise and tenon connection joint is a tab-and-slot connection joint.

5. The air-cooled heat exchanger of claim 1, wherein the air-cooled heat exchanger is a horizontal air-cooled heat exchanger.

6. The air-cooled heat exchanger of claim 1, wherein the frame assembly further comprises a base constructed from I-beam members.

7. The air-cooled heat exchanger of claim 1 wherein the first mortise and tenon connection joint has a first position on a keyed structural member and the second mortise and tenon connection has a second position on the keyed structural member, wherein the first and second positions are such that the first tenon fits within the first mortise but not the second mortise and the second tenon fits within the second mortise but not the first mortise so as to prevent improper assembly of the frame assembly.

8. The air-cooled heat exchanger of claim 1 wherein the tenon keyed structural member has only a single tenon having the first tenon shape and only a single tenon having the second tenon shape.

9. The air-cooled heat exchanger of claim 1 wherein the tenon keyed structural member is elongated and longitudinally extends between a first end and a second end and the first tenon is on or adjacent to a first end and the second tenon is on or adjacent to the second end.

10. The air-cooled heat exchanger of claim 9 wherein the tenon keyed structural member has only a single tenon having the first tenon shape and only a single tenon having the second tenon shape.

* * * * *